US006530304B1

(12) United States Patent
Nelson et al.

(10) Patent No.: US 6,530,304 B1
(45) Date of Patent: Mar. 11, 2003

(54) SHAPE CUTTING APPARATUS

(76) Inventors: Yvonne E. Nelson, 2525 Lorinda La., West Linn, OR (US) 97068; Maisie E. Nelson, 2525 Lorinda La., West Linn, OR (US) 97068

( * ) Notice: Subject to any disclaimer, the term of this patent is extended or adjusted under 35 U.S.C. 154(b) by 0 days.

(21) Appl. No.: 09/904,763

(22) Filed: Jul. 13, 2001

(51) Int. Cl.[7] ..... B26F 1/02; B26F 1/14

(52) U.S. Cl. ..... 83/620; 83/588; 83/691; 83/687; 30/358

(58) Field of Search ..... 83/588, 620, 618, 83/821, 684, 687, 691; 30/358, 359

(56) References Cited

U.S. PATENT DOCUMENTS

| | | | | | |
|---|---|---|---|---|---|
| 1,375,721 | A | * | 4/1921 | Nichols | 144/3.1 |
| 2,655,215 | A | | 10/1953 | Kertes | |
| 3,906,633 | A | * | 9/1975 | Inoue | 30/358 |
| 5,067,242 | A | | 11/1991 | Singer | |
| 5,243,887 | A | * | 9/1993 | Bonge, Jr. | 83/467.1 |
| 5,247,863 | A | * | 9/1993 | Cohen | 83/167 |
| 5,495,671 | A | * | 3/1996 | Shun-Yi | 30/358 |
| 5,601,006 | A | | 2/1997 | Quinn et al. | |
| 5,697,278 | A | | 12/1997 | Shun-Yi | |
| 5,749,278 | A | | 5/1998 | Lee et al. | |
| D407,752 | S | | 4/1999 | Kim et al. | |
| 5,893,313 | A | * | 4/1999 | Mori | 83/583 |
| 5,967,786 | A | * | 10/1999 | Wang | 434/81 |
| 6,000,139 | A | * | 12/1999 | Chan | 30/278 |
| 6,076,447 | A | * | 6/2000 | Damask | 83/167 |
| 6,089,137 | A | * | 7/2000 | Lee | 30/358 |
| 6,209,434 | B1 | * | 4/2001 | Kim et al. | 30/358 |

* cited by examiner

*Primary Examiner*—Paul T. Sewell
*Assistant Examiner*—Nimi F. Legesse

(57) ABSTRACT

A shape cutting apparatus for stamping a variety of shapes from thin sheet material. The shape cutting apparatus includes a body member having a cavity with a plurality of die bores, a plurality of die plugs designed to be inserted into the die bores, and a plunger cap designed for depressing the die plugs through a sheet member for producing shaped cutouts.

9 Claims, 2 Drawing Sheets

SHAPE CUTTING APPARATUS

BACKGROUND OF THE INVENTION

1. Field of the Invention

The present invention relates to shape cutting devices and more particularly pertains to a new shape cutting apparatus for stamping a variety of shapes from thin sheet material.

2. Description of the Prior Art The use of shape cutting devices is known in the prior art. More specifically, shape cutting devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,697,278; U.S. Pat. No. 5,749,278; U.S. Pat. No. 2,655,215; U.S. Pat. No. 5,067,242; U.S. Pat. No. 5,601,006; and U.S. Pat. No. Des. 407,752.

While these devices fulfill their respective, particular objectives and requirements, the aforementioned patents do not disclose a new shape cutting apparatus. The inventive device includes a body member having a cavity with a plurality of die bores, a plurality of die plugs designed to be inserted into the die bores, and a plunger cap designed for depressing the die plugs through a sheet member for producing shaped cutouts.

In these respects, the shape cutting apparatus according to the present invention substantially departs from the conventional concepts and designs of the prior art, and in so doing provides an apparatus primarily developed for the purpose of stamping a variety of shapes from thin sheet material.

SUMMARY OF THE INVENTION

In view of the foregoing disadvantages inherent in the known types of shape cutting devices now present in the prior art, the present invention provides a new shape cutting apparatus construction wherein the same can be utilized for stamping a variety of shapes from thin sheet material.

The general purpose of the present invention, which will be described subsequently in greater detail, is to provide a new shape cutting apparatus apparatus and method which has many of the advantages of the shape cutting devices mentioned heretofore and many novel features that result in a new shape cutting apparatus which is not anticipated, rendered obvious, suggested, or even implied by any of the prior art shape cutting devices, either alone or in any combination thereof.

To attain this, the present invention generally comprises a body member having a cavity with a plurality of die bores, a plurality of die plugs designed to be inserted into the die bores, and a plunger cap designed for depressing the die plugs through a sheet member for producing shaped cutouts.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new shape cutting apparatus apparatus and method which has many of the advantages of the shape cutting devices mentioned heretofore and many novel features that result in a new shape cutting apparatus which is not anticipated, rendered obvious, suggested, or even implied by any of the prior art shape cutting devices, either alone or in any combination thereof.

It is another object of the present invention to provide a new shape cutting apparatus which may be easily and efficiently manufactured and marketed.

It is a further object of the present invention to provide a new shape cutting apparatus which is of a durable and reliable construction.

An even further object of the present invention is to provide a new shape cutting apparatus which is susceptible of a low cost of manufacture with regard to both materials and labor, and which accordingly is then susceptible of low prices of sale to the consuming public, thereby making such shape cutting apparatus economically available to the buying public.

Still yet another object of the present invention is to provide a new shape cutting apparatus which provides in the apparatuses and methods of the prior art some of the advantages thereof, while simultaneously overcoming some of the disadvantages normally associated therewith.

Still another object of the present invention is to provide a new shape cutting apparatus for stamping a variety of shapes from thin sheet material.

Yet another object of the present invention is to provide a new shape cutting apparatus which includes a body member having a cavity with a plurality of die bores, a plurality of die plugs designed to be inserted into the die bores, and a plunger cap designed for depressing the die plugs through a sheet member for producing shaped cutouts.

Still yet another object of the present invention is to provide a new shape cutting apparatus that cuts out a plurality of shapes, letters or numbers all at one time.

Even still another object of the present invention is to provide a new shape cutting apparatus that allows the user to utilize an infinite number of die plugs to create a very universal system for making shaped cutouts out of a vast selection of sheet materials.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
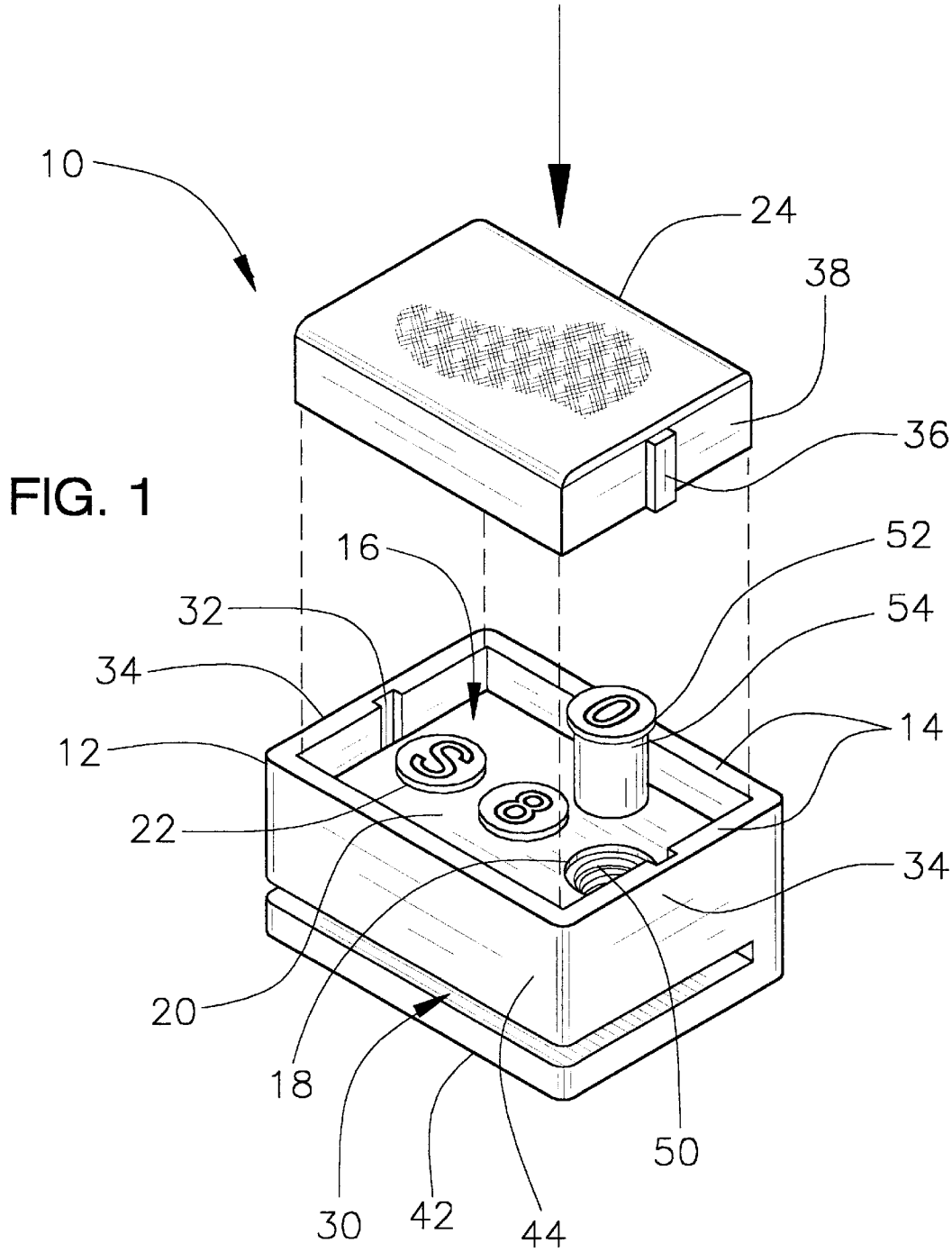
FIG. 1 is a schematic perspective view of a new shape cutting apparatus according to the present invention.
Figure 2:
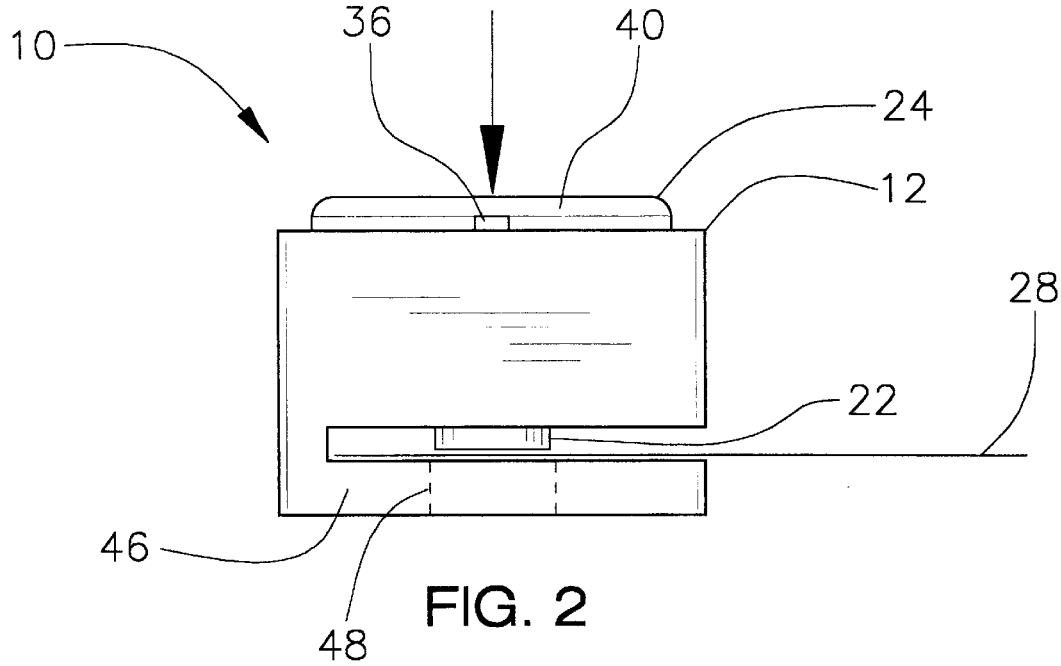
FIG. 2 is a schematic end view of the present invention.
Figure 3:
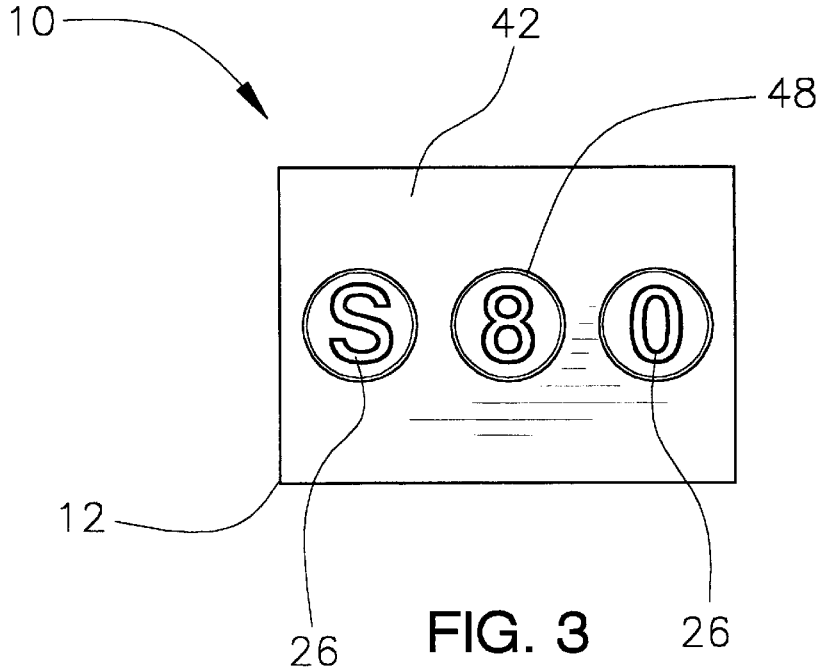
FIG. 3 is a schematic bottom view of the present invention.

With reference now to the drawings, and in particular to FIGS. 1 through 3 thereof, a new shape cutting apparatus embodying the principles and concepts of the present invention and generally designated by the reference numeral 10 will be described.

As best illustrated in FIGS. 1 through 3, the shape cutting apparatus 10 generally comprises a body member 12 that has perimeter walls 14 such that the walls 14 form a cavity 16. The cavity 16 includes a plurality of die bores 18. The die bores 18 are positioned in a base surface 20 of the cavity 16. The die bores 18 are designed for receiving a plurality of die plugs 22.

A plunger cap 24 is designed for being received into the cavity 16 of the body member 12. The plunger cap 24 manually biases the die plugs 22 substantially into the die bores 18, thereby cutting a plurality of shapes 26 associated with the die plugs 22 from a sheet material 28 when the sheet material 28 is inserted into a sheet slot 30 of the body member 12.

The body member 12 includes a plurality of guide slots 32. The guide slots 32 of the body member 12 are positioned inside of the cavity 16 at a medial portion of each of a pair of side walls 34 of the cavity 16.

The guide slots 32 are substantially parallel to a longitudinal axis of the die bores 18 such that the guide slots 32 are designed for slidably receiving a plurality of guide members 36 of the plunger cap 24.

The guide members 36 of the plunger cap 24 are positioned on end sides 38 of the plunger cap 24. When the guide members 36 are received in the guide slots 32, the plunger cap 24 is slidably received into the cavity 16 of the body member 12 while remaining substantially parallel to the base surface 20 of the cavity 16 for the purpose of contacting the die plugs 22 evenly.

The plunger cap 24 has a thickness substantially greater than a depth of the cavity 16. When the plunger cap 24 is fully received into the cavity 16, a top portion 40 of the plunger cap 24 is accessible to a user for grasping onto for removing the plunger cap 24 from the cavity 16.

The sheet slot 30 of the body member 12 is located proximate a bottom surface 42 of the body member 12 along a front wall 44 of the body member 12. The sheet slot 30 has a depth away from the front wall 44 substantially greater than a corresponding depth of the die bores 18. The sheet material 28 passes beyond the die bores 18, thereby ensuring that the die plugs 22 cut into a full portion of the sheet material 28 when the die plugs 22 are manually biased fully downwardly.

A base portion 46 of the body member 12 has a plurality of punch bores 48. The punch bores 48 are substantially aligned with the die bores 18 such that the die plugs 22 are partially received into the punch bores 48 when the die plugs 22 are manually biased fully downwardly.

The die bores 18 are designed for allowing the die plugs 22 to cut the sheet material 28 into shapes 26 corresponding to the die plugs 22 such that the cutout shapes 26 thereby fall downwardly into the punch bores 48 allowing the user to retrieve them, Each of the die bores 18 has a spring member 50. The spring members 50 are designed for biasing the die plugs 22 upwardly, thereby preventing the die plugs 22 from contacting the sheet material 28 until the die plugs 22 are manually biased downwardly by the plunger cap 24.

Each of the die plugs 22 has a cap portion 52. The cap portion 52 is positioned on an upper end 54 of the die plugs 22. A diameter of the cap portion 52 is substantially greater than a diameter of the die bores 18. When the die plugs 22 are manually biased downwardly by the plunger cap 24, the cap portion 52 of the die plugs 22 abut the base surface 20 at the cavity 16 thereby limiting a travel distance of the die plugs 22.

In the preferred usage of this apparatus, the primary shapes are the letters of the alphabet and the numbers 0–10, but this does not limit the many variety of different sizes and shapes that the die plugs could be provided in.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A shape cutting apparatus for stamping a variety of shapes from thin sheet material, the shape cutting apparatus comprising:

a body member having perimeter walls such that said walls form a cavity, said cavity including a plurality of die bores, said die bores being positioned in a base surface of said cavity, said body member having a sheet slot formed therein;

a plurality of die plugs, each of said die plugs being removably received in one of said die bores, each of said die plugs having a top; and a plunger cap removably received in said cavity of said body member, said plunger cap resting upon the top of all of said die plugs positioned in said die bores such that movement of said plunger cap inwardly into said cavity is transferred to all of said die plugs simultaneously for moving all of said die plugs simultaneously in said die bores into said sheet slot for simultaneously cutting a plurality of shapes associated with said die plugs from a sheet material when the sheet material is inserted into said sheet slot of said body member.

2. The shape cutting apparatus as set forth in claim 1, further comprising:

a plurality of guide members formed on said plunger cap;

wherein said body member includes a plurality of guide slots, each of said plurality of guide members being removably position in one of said guide slots of said body member.

3. The shape cutting apparatus as set forth in claim 2, further comprising:

said guide members of said plunger cap being positioned on end sides of said plunger cap such that when said guide members are received in said guide slots, said plunger cap is slidably received into said cavity of said body member while remaining substantially parallel to said base surface of said cavity for the purpose of contacting said die plugs evenly.

4. The shape cutting apparatus as set forth in claim 3, further comprising:

said plunger cap having a thickness substantially greater than a depth of said cavity such that when said plunger cap is fully received into said cavity, a top portion of said plunger cap is accessible to a user for grasping onto for removing said plunger cap from said cavity.

5. The shape cutting apparatus as set forth in claim 1, further comprising:

said sheet slot of said body member being located proximate a bottom surface of said body member along a front wall of said body member, said sheet slot having a depth away from said front wall substantially greater than a corresponding depth of said die bores such that the sheet material passes beyond said die bores, thereby ensuring that said die plugs cut into a full portion of the sheet material when said die plugs are manually biased fully downwardly.

6. The shape cutting apparatus as set forth in claim 1, further comprising:

a base portion of said body member having a plurality of punch bores, said punch bores being substantially aligned with said die bores such that said die plugs are partially received into said punch bores when said die plugs are manually biased fully downwardly; and said die bores being adapted for allowing said die plugs to cut the sheet material into shapes corresponding to said die plugs such that the cutout shapes thereby fall downwardly into said punch bores allowing the user to retrieve them.

7. The shape cutting apparatus as set forth in claim 1, further comprising:

each of said die bores having a spring member, said spring members being adapted for biasing said die plugs upwardly for preventing said die plugs from contacting the sheet material until said die plugs are manually biased downwardly by said plunger cap.

8. The shape cutting apparatus as set forth in claim 1, further comprising:

each of said die plugs having a cap portion, said cap portion being positioned on an upper end of said die plugs, a diameter of said cap portion being substantially greater than a diameter of said die bores such that when said die plugs are manually biased downwardly by said plunger cap, said cap portion of said die plugs abut said base surface at said cavity thereby limiting a travel distance of said die plugs.

9. A shape cutting apparatus for stamping a variety of shapes from thin sheet material, the shape cutting apparatus comprising:

a body member having perimeter walls such that said walls form a cavity, said cavity including a plurality of die bores, said die bores being positioned in a base surface of said cavity, said body member having a sheet slot formed therein;

a plurality of die plugs, each of said die plugs being removably received in one of said die bores, each of said die plugs having a top; and a plunger cap removably received in said cavity of said body member, said plunger cap resting upon the top of all of said die plugs positioned in said die bores such that movement of said plunger cap inwardly into said cavity is transferred to all of said die plugs simultaneously for moving all of said die plugs simultaneously in said die bores into said sheet slot for simultaneously cutting a plurality of shapes associated with said die plugs from a sheet material when the sheet material is inserted into said sheet slot of said body member;

a plurality of guide members formed on said plunger cap;

wherein said body member includes a plurality of guide slots, each of said plurality of guide members being removably position in one of said guide slots of said body member;

said guide members of said plunger cap being positioned on end sides of said plunger cap such that when said guide members are received in said guide slots, said plunger cap is slidably received into said cavity of said body member while remaining substantially parallel to said base surface of said cavity for the purpose of contacting said die plugs evenly;

said plunger cap having a thickness substantially greater than a depth of said cavity such that when said plunger cap is fully received into said cavity, a top portion of said plunger cap is accessible to a user for grasping onto for removing said plunger cap from said cavity;

said sheet slot of said body member being located proximate a bottom surface of said body member along a front wall of said body member, said sheet slot having a depth away from said front wall substantially greater than a corresponding depth of said die bores such that the sheet material passes beyond said die bores, thereby ensuring that said die plugs cut into a full portion of the sheet material when said die plugs are manually biased fully downwardly;

a base portion of said body member having a plurality of punch bores, said punch bores being substantially aligned with said die bores such that said die plugs are partially received into said punch bores when said die plugs are manually biased fully downwardly;

said die bores being adapted for allowing said die plugs to cut the sheet material into shapes corresponding to said die plugs such that the cutout shapes thereby fall downwardly into said punch bores allowing the user to retrieve them;

each of said die bores having a spring member, said spring members being adapted for biasing said die plugs upwardly for preventing said die plugs from contacting the sheet material until said die plugs are manually biased downwardly by said plunger cap; and each of said die plugs having a cap portion, said cap portion being positioned on an upper end of said die plugs, a diameter of said cap portion being substantially greater than a diameter of said die bores such that when said die plugs are manually biased downwardly by said plunger cap, said cap portion of said die plugs abut said base surface at said cavity thereby limiting a travel distance of said die plugs.

* * * * *